US007688223B2

(12) United States Patent
Magens et al.

(10) Patent No.: US 7,688,223 B2
(45) Date of Patent: Mar. 30, 2010

(54) SYSTEM FOR ASSISTING A DRIVER OF AN INDUSTRIAL TRUCK DURING DRIVING

(75) Inventors: Ernst-Peter Magens, Ammersbek (DE); Frank Manken, Henstedt-Ulzburg (DE); Martin von Werder, Ammersbek (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 215 days.

(21) Appl. No.: 11/524,336

(22) Filed: Sep. 20, 2006

(65) Prior Publication Data

US 2007/0069907 A1 Mar. 29, 2007

(30) Foreign Application Priority Data

Sep. 24, 2005 (DE) ..... 10 2005 045 721

(51) Int. Cl.
*G08G 1/09* (2006.01)

(52) U.S. Cl. ..... 340/905; 340/426.36; 455/41.1

(58) Field of Classification Search ... 340/572.1–572.9, 340/10.1, 901, 905, 10.2, 5.1, 825.37, 426.36; 455/41.1

See application file for complete search history.

(56) References Cited

U.S. PATENT DOCUMENTS

| | | | | |
|---|---|---|---|---|
| 4,621,252 | A | 11/1986 | Johns et al. | 340/61 |
| 4,849,735 | A | 7/1989 | Kirtley et al. | 340/539 |
| 5,198,800 | A | 3/1993 | Tozawa et al. | |
| 5,574,876 | A * | 11/1996 | Uchiyama et al. | 711/5 |
| 5,774,876 | A * | 6/1998 | Woolley et al. | 705/28 |
| 6,600,418 | B2 * | 7/2003 | Francis et al. | 340/572.1 |
| 6,720,888 | B2 * | 4/2004 | Eagleson et al. | 340/905 |
| 7,030,760 | B1 * | 4/2006 | Brown | 340/568.1 |
| 7,375,637 | B2 * | 5/2008 | Mickle et al. | 340/572.1 |
| 7,388,497 | B1 * | 6/2008 | Corbett et al. | 340/572.4 |
| 2002/0175825 | A1 | 11/2002 | Clerk et al. | |
| 2005/0200457 | A1 | 9/2005 | Bridgelall et al. | |
| 2005/0237161 | A1 * | 10/2005 | Lee et al. | 340/10.33 |
| 2008/0030335 | A1 * | 2/2008 | Nishida et al. | 340/572.1 |

FOREIGN PATENT DOCUMENTS

| | | |
|---|---|---|
| DE | 41 20 596 A1 | 2/1992 |
| DE | 20 2005 005 366 U1 | 6/2005 |
| DE | 20 2005 005 409 U1 | 7/2005 |
| WO | 96/40533 | 12/1996 |

OTHER PUBLICATIONS

"Radio Frequency Identification" aus Wikipedia, der freien Enzyklopadie (see note p. 2 of Information Disclosure Statement).

* cited by examiner

*Primary Examiner*—Davetta W Goins
*Assistant Examiner*—Edny Labbees
(74) *Attorney, Agent, or Firm*—Vidas, Arrett & Steinkraus, P.A.

(57) ABSTRACT

System for assisting a driver of an industrial truck with the following features: transponders are arranged at predetermined points of the working area of the industrial truck, the transponders are designed so that they transmit a UHF signal upon receipt of a transmission signal, the industrial truck comprises at least one aerial for transmitting and/or receiving an LF signal, an evaluation unit is arranged on the industrial truck which, upon receipt of a signal, sends said signal to an electronic evaluation unit for the UHF signals, the evaluation unit is connected to an on-board computer in the industrial truck.

8 Claims, 2 Drawing Sheets

SYSTEM FOR ASSISTING A DRIVER OF AN INDUSTRIAL TRUCK DURING DRIVING

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The top speed of an industrial truck is officially set. Moreover, the speed is set by the use and the requirements during operation. To accelerate loading and unloading, it is naturally desired to drive the vehicle as frequently as possible at maximum speed. When approaching critical points, such as driving through warehouses or by shelves or the like, the driver has to reduce the speed in good time so that no danger is caused. Generally, the effect on the speed is dependent on the location and destination of the driver. It is, moreover, also known, in the areas where industrial trucks are operated, to put up signs which serve to control the traffic.

It has become known from DE 20 2005 005 409 U1, the entire contents of which is hereby incorporated by reference in its entirety, to provide industrial trucks with a device for wireless communication with an RFID transponder. The device is either arranged laterally on a fork arm or on the rear face of the load fork. RFID transponders are attached to loads or pallets for receiving loads. Such transponders are denoted, for example, as tags. It has become known from US 2003/0089771 A1, the entire contents of which is hereby incorporated by reference in its entirety, to arrange aerials for communicating with transponders on the part of the fork carrier on the load side, flush therewith or projecting in the direction of the load. The aerial is connected via a cable to a reader on the industrial truck, and which in turn may be connected via a cable to an on-board computer, in order for example to convey information to the driver about the stockyard and the type of pallet. Two or more transponders are generally attached to the pallets, more than one aerial being also generally attached to the industrial truck in order to communicate with the transponders. It is also known from the last-mentioned publication to provide the transponder with a battery and also to arrange said transponder at specific locations, for example in a warehouse, in order to denote a location for the storage of pallets. When triggered, the transponders generate a UHF signal, for example, which is evaluated in an electronic evaluation device and, for example, identifies a relevant pallet as it is provided with a corresponding identification code via the transponder.

Whilst the previous use of RFID technology serves for pallet and stockyard identification, the object of the invention is to provide a system for assisting the driver of an industrial truck which directly communicates particular traffic conditions to the driver within the working area.

BRIEF SUMMARY OF THE INVENTION

With the system according to the invention, transponders which are preferably equipped with a battery are arranged at predetermined points of the working area of the industrial truck. A mains connection for the transponder is also possible. Such transponders are preferably attached at locations where the driver has to be particularly attentive, for example in the vicinity of the passage of industrial trucks, in the vicinity of shelves or the like, which generally oblige the driver to reduce the driving speed. Information is held in the memory of the transponder, therefore, about which function of the industrial truck is mandatory or prohibited in the range of the transponder, for example the lifting height of a mast, the speed, driving with an internal combustion engine in the warehouse, etc. It is possible to indicate to the driver, for example, which speed should preferably be set, if the driver comes into the vicinity of said locations or that the driver should stop the vehicle.

With the system according to the invention, the transponder is provided according to an embodiment with a battery, so that a sufficient range may be achieved, of, for example, up to 10 m. The circuit in the transponder is preferably designed so that its transmission circuit is normally switched off, so that energy is not used. Only when a signal, preferably an LF signal, is received by the transponder, by means of an aerial, is said transponder activated and transmits, for example, a UHF signal. It is conceivable to stop the transmission of the UHF signal when a specific time has passed. It is, however, also conceivable to transmit the UHF signal at intervals and to establish in the meantime whether an activation signal has been received. A UHF signal is transmitted by the transponder only if this is the case.

In an evaluation unit which is accommodated at a suitable point in the industrial truck, the UHF signal is received by means of a more or less integral aerial. The aerial may project externally on a housing for the evaluation unit, if said housing consists of metal, for example, or it may be arranged within a housing, if it is permeable to microwaves. Such receiving aerials are known per se.

The aerial of the evaluation unit may also serve as a transmission aerial, the transmitted signal selectively forming the alarm signal for a transponder, only if it comprises a battery, or also transmit the energy to a transponder, so that said transponder is able to transmit its data.

The evaluation electronics of the evaluation unit detects from the UHF signal the information contained therein and sends it to an on-board computer which is normally present in the industrial truck. The driver then receives a corresponding instruction on a display about the current 'traffic situation' and may therefore adapt thereto, for example, by reducing the driving speed, by retracting the mast, switching the drive from internal combustion engine to battery operation, etc.

If, simultaneously, a plurality of transponders are in range, all UHF signals of the transponders are received by the evaluation unit and may be shown to the driver in an appropriate manner. The invention is, therefore, an aid for the driver and via which additional information is made available to the driver, without taking full responsibility and control of the industrial truck from the driver. Nevertheless, it is also conceivable, for example, to intervene actively in the speed regulation of the drive mechanism or in any other functions.

By means of the invention, the operational safety of the industrial truck is increased, whereby fewer accidents are caused, by additional information being made available to the driver. The system according to the invention leads to a reduction of damage to building equipment, for example roller doors. The invention may be installed on existing devices and industrial trucks, without this installation being associated with a considerable increase in cost. If the transponders only occasionally transmit UHF signals, long battery running times result.

According to an embodiment of the invention, a first aerial is attached to the overhead guard of the industrial truck. Due the relatively low frequency in an LF transmitted signal, the first aerial requires a relatively large extension. There is sufficient space therefor on the overhead guard.

Naturally, a transmission circuit is also required for the preferably LF signal. Preferably, the transmission circuit is also accommodated in the evaluation unit, a cable extending between the evaluation unit and the first aerial.

A monitoring circuit may be provided in the industrial truck which monitors the individual functions of the industrial truck, such as for example vehicle speed, lifting height, size of the load received, type of drive with a hybrid drive (internal combustion engine and battery driven electric motor) etc. Data are stored in the transponder which may correspond to traffic signs for prohibited functions or mandatory functions, for example maximum lifting height, maximum speed, stop function, etc. If the evaluation device of the industrial truck receives such a signal, the data are compared with the current data in the monitoring circuit. If the vehicle does not exceed the top speed set in the range of the transponder, there is no display. If, however, the top speed is exceeded, this is indicated to the driver on the display. The same applies, for example, to the lifting height. If, in the region of the transponder, a maximum lifting height is set which may not be exceeded, the current lifting height of the mast is compared with the data. If there is a difference, i.e. the current lifting height exceeds the set lifting height, this is indicated to the driver. If the vehicle does not stop at a desired point as is indicated by the traffic sign and/or from the data in the transponder, this is also indicated to the driver, so that the driver obtains an appropriate instruction for the prohibited function or mandatory function. Generally, it may be established that information relating to the location is stored and transmitted in the transponder and which is read by the system of the industrial truck, the information being shown to the driver according to the state of the industrial truck, i.e. only in such cases when the current function does not correspond to the stored prohibited function or mandatory function, but should correspond thereto.

Finally, it is also conceivable to activate the transponders from other sources, for example a transponder on a roller door which, for example, activates the transponder when the roller door is closed or even vice versa.

BRIEF DESCRIPTION OF THE DRAWINGS

The invention is described in more detail hereinafter with reference to an embodiment.

DETAILED DESCRIPTION OF THE INVENTION

Figures 1A, 1B:
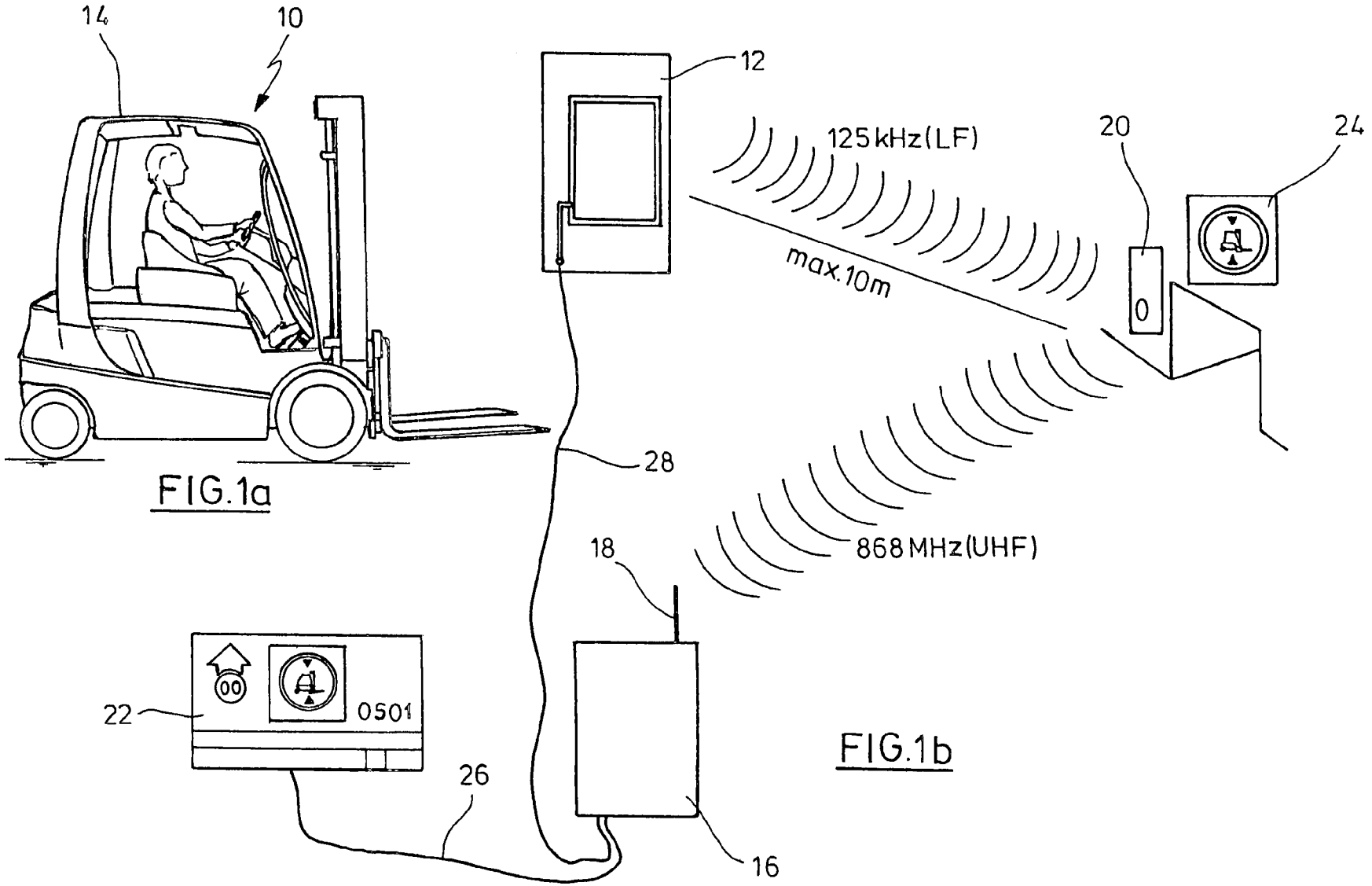
FIG. 1*a* is an industrial truck with a system according to the invention
FIG. 1*b* shows the system according to the invention diagrammatically

While this invention may be embodied in many different forms, there are described in detail herein a specific preferred embodiment of the invention. This description is an exemplification of the principles of the invention and is not intended to limit the invention to the particular embodiment illustrated A counterbalanced lift truck 10 is indicated in FIG. 1*a* which is designed in the conventional manner. Individual parts are, therefore, not to be described. FIG. 1*b* shows a system with a first aerial 12 which is designed as plastic sheeting or plastics plate, and is attached to an overhead guard 14 of the lift truck 10. A housing or a box is indicated at 16 which has a second aerial 18 and in which is arranged a transmission circuit for LF and a receiving circuit for UHF and an evaluation circuit. By means of the transmission circuit a signal is transmitted, at for example 125 kHz, via the aerial 12, the range being approximately 10 m maximum. If a transponder 20 is located in this range then, upon receipt of the LF signal, a UHF signal, for example at the frequency of 868 MHz, is transmitted thereby. The transponder 20 is fitted with a battery and is usually switched off. Only upon receipt of the LF signal is the transmission circuit of the transponder 10 switched on, so that the disclosed UHF signal is transmitted. The UHF signal is received by the aerial 18 and evaluated in the evaluation circuit. An interface for a connection to an on-board computer in the lift truck 10 is located on the housing 16, and which is indicated by a display 22 in FIG. 1. The transponder is located, for example, in the region of a warehouse door which only allows the passage of vehicles up to a specific height. In the region of the door, moreover, a traffic sign 24 is arranged, in the present case the transponder 20 being attached to the traffic sign or in its immediate vicinity. The information stored in the transponder 20 and transmitted upon activation, therefore corresponds, for example, to the content of the traffic sign 24 (mandatory function or prohibited function). This is repeated on the display, as is visible in FIG. 1. The driver therefore recognises that he is approaching a warehouse door of which the height for the passage of vehicles is restricted. The connection between the evaluation unit in the housing 16 and the computer is provided by a cable 26. Moreover, as mentioned, the transmission circuit for the LF signal is arranged in the housing 16. Therefore a cable 28 is provided between the housing 16 and the aerial 12 on the overhead guard 14.

Figure 2:
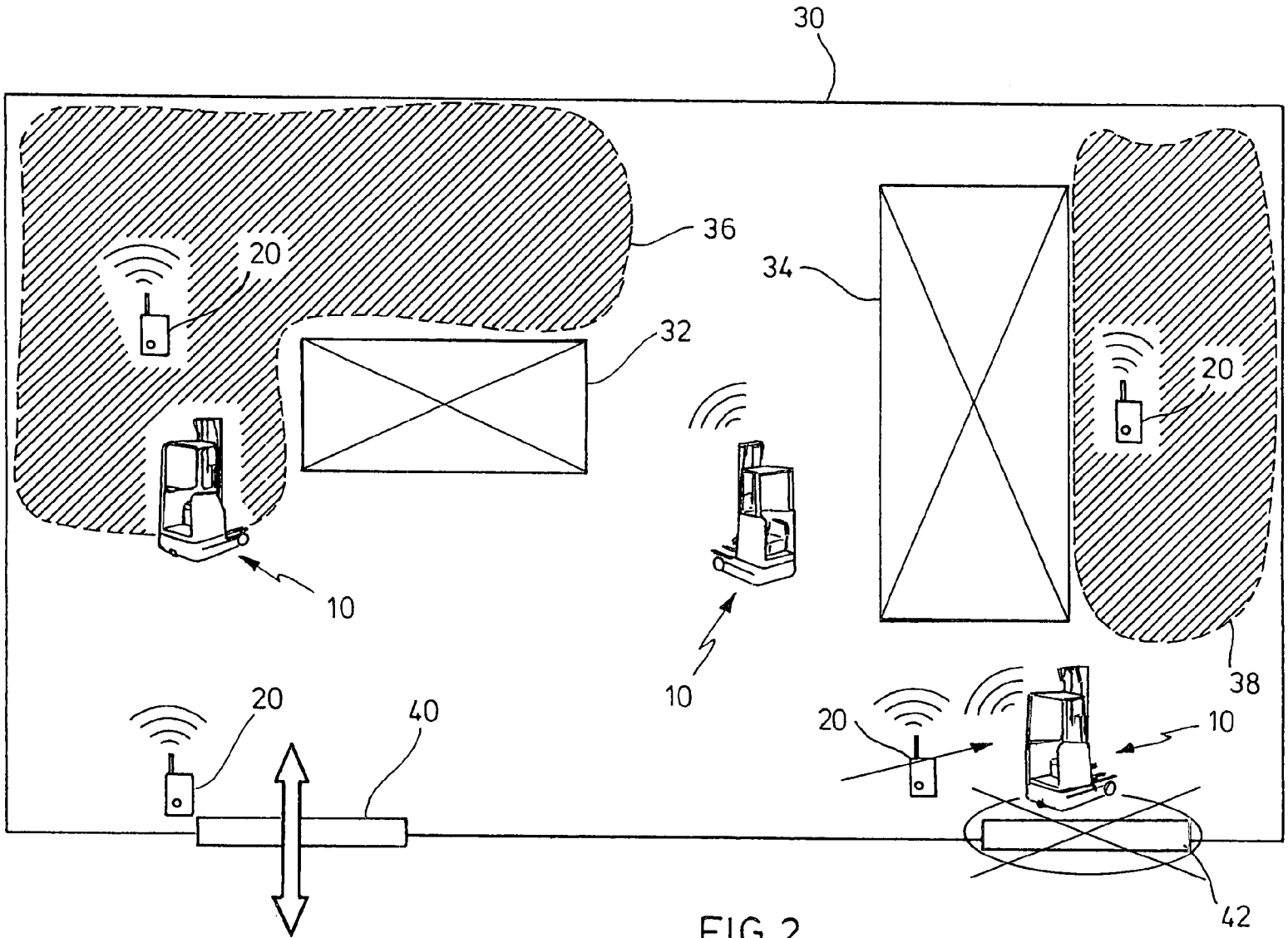
FIG. 2 shows the operation of the system according to FIG. 1 in a warehouse.

The layout of a warehouse is arranged in FIG. 2 at 30 in which shelf arrangements 32 and/or 34 are arranged. By means of shaded areas 36, 38 zones are indicated in which the driver of the industrial truck, which is shown in FIG. 2 in three different positions, has to drive particularly carefully, in particular at reduced speed. It may be seen that in these areas one respective transponder 20 is arranged according to FIG. 1. In FIG. 2, moreover, an open door 40 and a closed door 42 are marked, with which, in turn, one respective transponder 20 is associated. The transponder 20 signals to the driver that the door is closed, and that the driver therefore has to stop in time in order to wait, for example, until the roller door opens. The transponder 20 at the door 40 provides, for example, the height for the passage of vehicles, as in FIG. 1. The transponders 20 in the danger zones 36, 38 indicate to the driver that the speed should be reduced.

A monitoring circuit may be provided in the on-board computer which monitors the individual functions of the industrial truck 10 and, for example, stores data about the speed, height of the lifting mast, size of the load, etc. Functions of the industrial truck which are either prohibited or mandatory at the location of, or in the vicinity of, the transponder are now stored in the transponders. The lifting height through which the door of a building may be passed is therefore set, for example. The top speed which may be driven may also be set. The UHF signal contains data about the mandatory functions or prohibited functions which the monitoring circuit compares with the current respective function. If there is a difference between the functions stored in the transponders and the current functions, if the vehicle is driven, for example, too fast or if the lifting height is too great, this is indicated to the driver. The same applies, for example, if a vehicle comprises a hybrid drive and is driven from the outside into the warehouse. In this connection, it has to be ensured that internal combustion engines are not driven in the warehouse.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. System for assisting a driver of an industrial truck comprising:

a plurality of transponders (20), having active and inactive states, and normally being in the inactive state, and being arranged at predetermined points of the working area of the industrial truck (10), the plurality of transponders receiving at a LF frequency and transmitting at a UHF frequency;

the transponders (20), upon receipt of the LF frequency signal, switch from the inactive state to the active state and transmit a UHF frequency signal;

the industrial truck (10) having at least one transmission and receiving device and at least one antenna for transmitting and/or receiving a signal towards and from at least one transponder, the transmission and receiving device transmitting at a LF frequency and receiving at a UHF frequency;

the transponders transmit the UHF-signal upon receipt of the LF signal from the transmission and receiving device;

an electronic evaluation unit (16) for the UHF-signals is arranged on the industrial truck (10) and the electronic evaluation unit is connected with an on-board-computer in the industrial truck so that an indication for the driver is generated or a speed of the industrial truck is influenced through a control means for a driving means for the industrial truck;

further characterised in that the transponders (20) are fitted with batteries and upon receipt of the LF frequency signal, transmit the UHF frequency signal, the industrial truck has a first aerial for transmitting the transmission signal, and the evaluation unit has a second aerial for the receipt of the UHF frequency signal, and further characterised in that on the industrial truck a monitoring circuit is provided which monitors the functions of the industrial truck, data relative to the functions of the industrial truck are stored in the transponder which correspond to prohibited functions or mandatory functions at the location of, or in the vicinity of, the transponders and the monitoring circuit compares the signals coming from the transponders with the respective function and it is indicated to the driver on a display when the respective function deviates from the prohibited function or mandatory function contained in the signal.

2. System according to claim 1, characterised in that the transponders (20) are attached to, or in the vicinity of, traffic signs (24).

3. System according to claim 1, characterised in that a first aerial (12) is attached to an overhead guard of the industrial truck.

4. System according to claim 1, characterised in that the industrial truck has a control device for controlling a drive of the industrial truck, and its speed, according to the UHF signal.

5. System according to claim 1, characterised in that a transmission circuit for the transmission signal, is arranged in the evaluation unit (16) and the evaluation unit (16) is connected via a cable (28) to the transmission aerial (12).

6. System according to claim 1, characterised in that a main connection is provided as a supply terminal for the transponders.

7. System according to claim 1, characterised in that the aerial is attached to a front or rear windscreen or to a lift device of the industrial truck.

8. System according to claim 1, characterised in that the transponders are activated by external control devices in the operating area of the industrial truck.

* * * * *